United States Patent [19]

Lorenz

[11] Patent Number: 4,468,920

[45] Date of Patent: Sep. 4, 1984

[54] PNEUMATICALLY THREADABLE YARN BRAKE AND A TWO-FOR-ONE TWISTING SPINDLE EQUIPPED THEREWITH

[75] Inventor: Rainer Lorenz, Nettetal-Breyell, Fed. Rep. of Germany

[73] Assignee: Palitex Project-Company GmbH, Krefeld, Fed. Rep. of Germany

[21] Appl. No.: 346,369

[22] Filed: Feb. 5, 1982

[30] Foreign Application Priority Data

Feb. 11, 1981 [DE] Fed. Rep. of Germany ..... 3104748326

[51] Int. Cl.[3] ..... D01H 13/10; D01H 7/86; D01H 15/00; B65H 59/22

[52] U.S. Cl. ..... 57/279; 57/58.86; 242/149

[58] Field of Search ..... 57/58.83, 58.8 C, 58.9, 57/279, 280; 242/147 R, 149, 152.1

[56] References Cited

U.S. PATENT DOCUMENTS 4,281,508 8/1981 Frentzel-Beyme ..... 57/58.86 X 4,302,930 12/1981 Franzen ..... 57/279

*Primary Examiner*—John Petrakes

[57] ABSTRACT

In a pneumatically threadable yarn brake, in which a substantially capsular brake cartridge (7) abuts against an upper (8) and lower (9) brake surface ring in a brake housing, the lower brake surface ring (9) is connected to an annular diaphragm (16) which is downwardly adjustable or movable under the action of a vacuum, at the same time carrying along the lower brake surface ring (9).

9 Claims, 2 Drawing Figures

PNEUMATICALLY THREADABLE YARN BRAKE AND A TWO-FOR-ONE TWISTING SPINDLE EQUIPPED THEREWITH

BACKGROUND AND OBJECTIVES OF THE INVENTION

The invention relates to a pneumatically threadable yarn brake having a substantially tubular brake housing in which a substantially capsular brake cartridge abuts against a lower and an upper brake surface ring, the lower of which brake surface rings is axially displaceable downwardly against a restoring force by the action of a vacuum for the purpose of venting the yarn brake, the brake cartridge having an associated holding device which retains the brake cartridge in an intermediate position with spacing between the upper and lower brake surface rings when the lower brake surface ring is displaced downwardly.

In yarn brakes of this kind described in British patent specification Nos. 2024878A and 20446314A, the lower brake surface ring is fitted centrally in a piston which is axially displaceable within the brake housing and which, for the purpose of releasing the yarn brake, is displaceable downwardly under the action of the vacuum produced by, for example, a yarn threading device in the manner of an injector. In an arrangement of this kind, difficulties can arise with respect to guiding the piston within the brake housing, since, on the one hand, specific sealing between the periphery of the piston and the brake housing is required in order to produce an adequate vacuum, whilst, on the other hand, dust, fiber fly, residues of yarn, brightening agent sprayed from the yarn, and wetting agent can lead to impairment or obstruction of the movement between the piston and the cylinder wall formed by the brake housing. The difficulties arising in this connection, can, of course, be avoided.

An objective of the invention is to design a yarn brake releasable by vacuum, such that the axial displacement of the lower brake surface ring is not impaired by contamination of the above-mentioned kind occurring within the brake housing.

A pneumatically threadable yarn brake in accordance with the invention has a substantially tubular brake housing in which a brake cartridge abuts against a lower and an upper brake surface ring, the lower of which brake surface rings is axially displaceable downwardly against a restoring force for the purpose of releasing the yarn brake cartridge having an associated holding device which retains the brake cartridge in an intermediate position with spacing between the upper and lower brake surface rings when the lower brake surface ring is displaced downwardly, the lower brake surface ring being secured to an annular diaphragm whose outer periphery is fixedly clampable and which defines the top of a chamber connectible to a source of vacuum for the purpose of displacing the diaphragm against the restoring force.

Any contamination which occurs does not affect the movement of this annular diaphragm, since, in contrast to the above-mentioned piston and cylinder combination, there is now no need for sealing surfaces which move or slide relative to one another.

SUMMARY OF THE INVENTION

In a preferred embodiment of the invention, the spring rate of the annular diaphragm is graduated in an axial direction corresponding to the restoring force, so that the resilient properties of the diaphragm are used to restore the brake system and also to apply the resilient brake force.

In a preferred embodiment of the invention, the annular diaphragm is disposed below the lower brake surface ring and is secured thereto by a tubular member which interconnects the central opeings of the lower brake surface ring and the annular diaphragm. Preferably, this tubular member has an abutment for the top end of a return spring whose bottom end abuts against a stationary abutment which is substantially in the shape of a radially inwardly directed annular shoulder. This return spring at the same time determines the brake force applied by the yarn brake at any given time, in dependence upon the prevailing distances between the upper and lower abutments or support points, particularly when the brake cartridge is in the form of any inherently rigid element.

In the preferred embodiment of the invention, the tubular member has an extension which extends upwardly beyond the lower brake surface ring and which substantially forms the brake housing and surrounds the brake cartridge and preferably also the holding device.

The invention further relates to a two-for-one twisting spindle equipped with the novel yarn brake and having a yarn threading device which is effective in the manner of an injector and which is disposed above the spindle rotor in the region of the fixedly held hollow axle of the spindle for the purpose of producing a vacuum for drawing in the yarn to be threaded.

The invention will be further described, by way of example, with reference to the accompanying drawings.

DETAILED DESCRIPTION OF A PREFERRED EMBODIMENT

Figure 1:
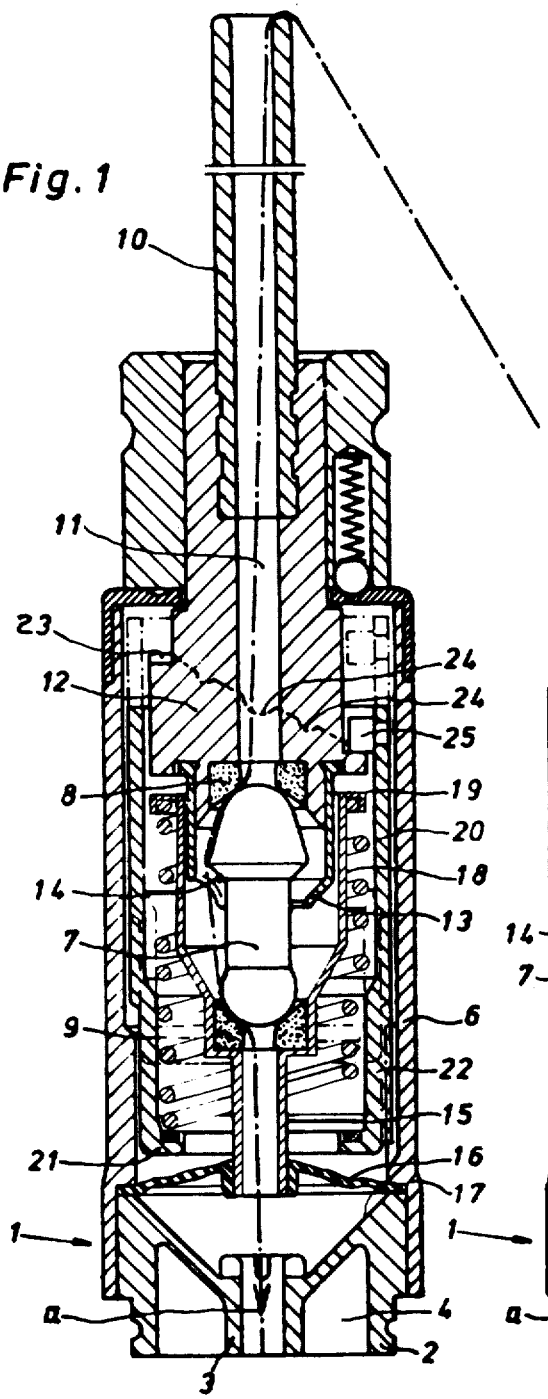
FIG. 1 is an axial section through a yarn brake, in accordance with the invention, in its braking position, associated with a two-for-one twisting spindle.
Figure 2:
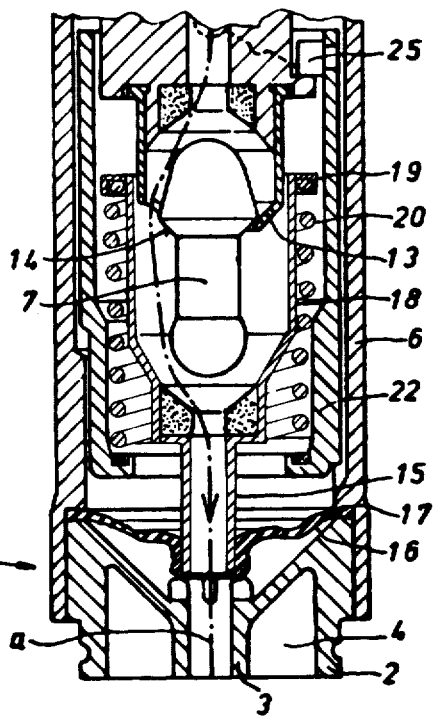
FIG. 2 is an illustration, corresponding to FIG. 1, with the yarn brake open or vented to vacuum.

FIGS. 1 and 2 show a slip-one or insert body 1 which forms the upper part of a hollow axle of a two-for-one twisting spindle and which, on the one hand, comprises essential parts of a compressed-air-operated yarn threading device which is effective in the manner of an injector, and, on the other hand, the yarn brake which is releasable under the action of the yarn threading device. The slip-on or insert body 1 includes a lower slip-on sleeve 2 having a central socket 3 which forms part of the yarn threading device effective in the manner of an injector and which, when the two-for-one twisting spindle is in its fully mounted state, opens into the stationary held (not illustrated) hollow axle of the two-for-one twisting spindle, optionally by way of further, inerposed tubular members, to form an annular gap. A downwardly directed flow of suction air a can be induced in the socket 3, for example, by means of an injector wherein a downwardly directed flow of compressed air is built up in a passage 4 surrounding the socket 3, as is described in German patent specification No. 24 61 756 in, for example, a two-for-one twisting spindle.

A hollow cylinder 6 is screwed onto the slip-on sleeve 2. A thread brake assembly is fitted into the hollow cylinder 6 and its essential components comprise a rigid or, alternatively, a slightly expansible brake cartridge 7 which, as is shown in FIG. 1, is supported between an upper brake surface ring 8 and a lower brake surface ring 9. An axial passage 11, merging into the yarn threading tube 10, is contiguous to the upper brake surface ring 8. The upper brake surface ring 8 is inserted centrally into a support body 12 which carries a holding or support device for the brake cartridge 7. This support device is in the form of radially inwardly directed support dogs 13 which are spaced apart in a circumferential direction. The brake cartridge 7 is provided with a shoulder 14 which, is shown in FIG. 2, cooperates with the support dogs 13 or is supported thereon.

The lower brake surface ring 9, adjustable or movable in an axial direction, is connected by way of a tubular member 15 to an annular diaphragm 16 which is located below the brake surface ring 9 and whose outer circumference is rigidly clamped between the top edge of the slip-on sleeve 2 and a support shoulder 17 in the hollow cylinder 6. A cylindrical extension 18 extending upwardly beyond the lower brake surface ring 9 is contiguous to the tubular member 15 and is substantially in the form of a brake housing and surrounds or accommodates the brake cartridge 7 and preferably also the holding or support device formed by the support dogs 13. Alternatively, however, the annular diaphragm 16 could be connected directly to the lower brake surface ring 9.

The top end of the cylindrical extension 18 has an outwardly directed annular shoulder 19 serving as an axially displaceable upper abutment for a return spring 20. The bottom end of the return spring 20 abuts against a stationary abutment in the form of a substantially radially inwardly directed annular shoulder 21. The annular shoulder 21 forms the bottom end of a cylindrical sleeve 22 which is adjustable in an axial direction for the purpose of adjusting the brake force and which is lockable in different vertical positions. For the purpose of adjusting and locking the cylindrical sleeve 22, the outer periphery of the support body 12 is provided with a support arrangement 23 which includes notch-like indentations 24 located at differing vertical positions for a detent or locking body 25 secured to the top end of the cylindrical sleeve 22.

As already mentioned, FIG. 1 shows the arrangement forming a part of a two-for-one twisting spindle in the braking position of the yarn brake corresponding to normal running of the yarn or spindle.

When the yarn brake has to be released, for example, for threading a yarn through the spindle, a vacuum is induced in the chamber below the annular diaphragm 16 by building up within the socket 3 a flow of suction air effective in the direction of the arrow a. As a result of the vacuum thereby building up below the annular diaphragm 16, the annular diaphragm 16 is drawn or adjusted downwardly, whereby the lower brake surface ring 9 is displaced axially downwardly optionally directly or, alternatively, by way of the tubular member 15. When the brake cartridge 7 is no longer supported by the lower brake surface ring 9, it drops under the action of the force of gravity until its shoulder 14 is engaged by the radially inwardly directed support dogs 13, and, when in its intermediate position illustrated in FIG. 2, it is retained between, and at a distance from, the upper and lower brake surface rings. In the case of a two-for-one twisting spindle, the downwardly directed compressed air flowing into the compressed air passage 4 enters the hollow axle of the spindle (not illustrated) in the form of a downwardly directed jet of compressed air. The flow of suction air induced within the socket 3 by the injector action is propagated through the tubular member 15, the cylindrical extension 18, the passage 11 and the yarn threading tube 10 up to the top end of the yarn threading or yarn inlet tube, so that a yarn held on this top end of the yarn threading tube can be conveyed past the brake cartridge 7 through the hollow axle of the spindle and the spindle rotor.

After termination of the threading operation, the supply of compressed air to the compressed air passage 4 is interrupted, whereby the flow of suction air produced by the injector action is decreased, so that the cylindrical extension 18 together with the lower brake surface ring 9, the tubular member 15 and the annular diaphragm 16 are again returned upwardly into the braking position illustrated in FIG. 1 under the action of the restoring force inherent in the diaphragm or the return spring 10, the brake cartridge 7 at the same time also being lifted from the support dogs 13 again and moved upwardly. The annular diaphragm 16 preferably has a spring rate corresponding to the restoring force.

Preferably additional vents and breather ports, provided in the region of a support shoulder limiting the downward movement of the annular diaphragm (see FIG. 2), open into the chamber located below the annular diaphragm 16.

The yarn brake in accordance with the invention can be used universally in textile processing whenever the yarn has to be maintained under a predetermined tension after the yarn has been pneumatically threaded. Thus, the yarn brake can be used universally whenever a yarn runs from a creel and is fed to a processing unit. Examples of this are, in addition to two-for-one twisting spindles, magazine creels and beaming creels or, alternatively, spooling machines and doubling machines which require yarn brakes in order to allow the yarns to run under uniform tension onto a winding body, a cross-wound bobbin in the present case. Bobbin magazines of batteries can also be equipped with the yarn brake in accordance with the invention. One of the most widely known and most frequently used bobbin magazines is employed on weaving machines in which the weft yarns have to be correspondingly braked before insertion.

I claim:

1. A pneumatically threadable yarn brake comprising; an insert body, a substantially tubular brake housing having a lower and an upper brake surface ring spaced from each other in said body, a brake cartridge abuts against said lower and said upper brake surface ring, a restoring source means, the lower of said brake surface rings is axially displaceable downwardly against said restoring force for the purpose of releasing the yarn brake, said brake cartridge having an associated holding device which retains said brake cartridge in an intermediate position with spacing between said upper and said lower brake surface rings when the lower brake surface ring is displaced downwardly, a cylindrical extension surrounding said rings and brake cartridge, an annular diaphragm having an outer periphery fixedly clampable to said insert body and to said lower brake surface whereby said diaphragm defines the top of said body which is connectible to a source of vacuum for the purpose of displacing said diaphragm against said restoring force.

2. A pneumatically threadable yarn brake as claimed in claim 1, in which the spring rate of said annular diaphragm is graduated in an axial direction corresponding to said restoring force.

3. A pneumatically threadable yarn brake as claimed in claim 1, in which said annular diaphragm is disposed below said lower brake surface ring, and a tubular member secured to said annular diaphragm which said tubular member interconnects with said lower brake surface ring and said annular diaphragm.

4. A pneumatically threadable yarn brake as claimed in claim 3, said tubular member connects to said cylindrical extension and having a top end spring retaining abutment, a cylindrical sleeve in said body, a stationary abutment in said cylindrical sleeve which is substantially in the shape of a radially inwardly directed annular shoulder, and said restroring source means in the form of a return spring extending between said top end spring retaining abutment and said annular shoulder.

5. A pneumatically threadable yarn brake as claimed in claim 4, said stationary abutment being lockable in different vertical positions.

6. A yarn brake as claimed in claim 1, wherein said cylindrical extension also surrounds said holding device.

7. A pneumatically threadable yarn brake as claimed in claim 1, and vents and breather ports open into said body located below said annular diaphragm.

8. A pneumatically threadable yarn brake as claimed in claim 1, and an injector means associated with said source of vacuum for drawing yarn to be threaded into said tubular brake housing for threading a two-for-one spindle.

9. A pneumatically threadable yarn brake for a two-for-one twisting spindle as claimed in claim 1, and having a compressed-air-operated yarn threading device in the manner of an injector, said spindle having a spindle rotor, said injector being disposed above said spindle rotor for the purpose of producing a vacuum for drawing in the yarn to be threaded.

* * * * *